US010289015B2

(12) United States Patent
Nishitera

(10) Patent No.: US 10,289,015 B2
(45) Date of Patent: May 14, 2019

(54) ELECTROSTATIC LATENT IMAGE DEVELOPING TONER AND METHOD FOR PRODUCING THE SAME

(71) Applicant: KYOCERA Document Solutions Inc., Osaka (JP)

(72) Inventor: Haruhiro Nishitera, Osaka (JP)

(73) Assignee: KYCOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/767,301

(22) PCT Filed: Jul. 10, 2017

(86) PCT No.: PCT/JP2017/025140

§ 371 (c)(1),
(2) Date: Apr. 10, 2018

(87) PCT Pub. No.: WO2018/020998

PCT Pub. Date: Feb. 1, 2018

(65) Prior Publication Data

US 2018/0307151 A1 Oct. 25, 2018

(30) Foreign Application Priority Data

Jul. 27, 2016 (JP) ..... 2016-147350

(51) Int. Cl.
*G03G 9/087* (2006.01)
*G03G 9/08* (2006.01)

(52) U.S. Cl.
CPC ..... *G03G 9/08755* (2013.01); *G03G 9/08* (2013.01); *G03G 9/087* (2013.01); *G03G 9/08793* (2013.01); *G03G 9/0806* (2013.01)

(58) Field of Classification Search
CPC ..... G03G 9/08797; G03G 9/08795; G03G 9/08755
See application file for complete search history.

(56) References Cited

U.S. PATENT DOCUMENTS 6,132,921 A * 10/2000 Ishiyama ..... G03G 9/0821 430/109.3
8,227,164 B2 * 7/2012 Sugimoto ..... G03G 9/0804 430/108.2

(Continued)

FOREIGN PATENT DOCUMENTS

JP 2013-088503 A 5/2013

*Primary Examiner* — Peter L Vajda
(74) *Attorney, Agent, or Firm* — Studebaker & Brackett PC

(57) ABSTRACT

An electrostatic latent image developing toner includes a plurality of toner particles containing a binder resin. The toner particles have a cross-linking structure originating from a high-molecular cross-linking agent. A storage elastic modulus of the toner at a temperature of 80° C. is at least $1.0\times10^3$ Pa and no greater than $5.0\times10^4$ Pa. A storage elastic modulus of the toner at a temperature of 120° C. is at least $1.0\times10^3$ Pa and no greater than $1.0\times10^4$ Pa. A cross-linking density Nx represented by formula (1) is at least $2.9\times10^{-7}$ mol/cm$^3$ and no greater than $2.5\times10^{-6}$ mol/cm$^3$. A loss tangent tan δx represented by formula (2) is at least 0.05 and no greater than 0.50.

$$Nx=10\times Gx/R\times(T_{10000}+343) \quad (1)$$

$$\tan \delta x=Gy/Gx \quad (2)$$

9 Claims, 2 Drawing Sheets

(56) References Cited

U.S. PATENT DOCUMENTS

| | | | |
|---|---|---|---|
| 8,889,327 | B2 | 11/2014 | Takemori |
| 2013/0095423 | A1 | 4/2013 | Takemori |

* cited by examiner

ELECTROSTATIC LATENT IMAGE DEVELOPING TONER AND METHOD FOR PRODUCING THE SAME

TECHNICAL FIELD

The present invention relates to an electrostatic latent image developing toner and a method for producing the same.

BACKGROUND ART

A toner disclosed in Patent Literature 1 includes a binder resin containing a non-crystalline polyester resin and a cross-linkable polyester resin. A toner production method disclosed in Patent Literature 1 includes cross-linking the cross-linkable polyester resin using a low-molecular cross-linking agent (1,4-phenylenebisoxazoline).

CITATION LIST

Patent Literature

[Patent Literature 1]
Japanese Patent Application Laid-Open Publication No. 2013-88503

SUMMARY OF INVENTION

Technical Problem

The technique disclosed in Patent Literature 1 allows production of a toner excellent in low-temperature fixability, hot offset resistance, and heat-resistant preservability. However, the technique disclosed in Patent Literature 1 alone is not enough to allow easy production of an electrostatic latent image developing toner that has viscoelasticity suitable for both low-temperature fixing and high-temperature fixing and that is excellent in all of low-temperature fixability, hot offset resistance, and heat-resistant preservability. It is difficult to control the cross-linking state with the use of a low-molecular cross-linking agent.

The present invention was achieved in consideration of the above problem and an objective thereof is to provide an electrostatic latent image developing toner that has viscoelasticity suitable for both low-temperature fixing and high-temperature fixing and that is excellent in all of low-temperature fixability, hot offset resistance, and heat-resistant preservability.

Solution to Problem

An electrostatic latent image developing toner according to the present invention includes a plurality of toner particles containing a binder resin. The toner particles have a cross-linking structure originating from a high-molecular cross-linking agent. A storage elastic modulus of the toner at a temperature of 80° C. is at least $1.0\times10^3$ Pa and no greater than $5.0\times10^4$ Pa. A storage elastic modulus of the toner at a temperature of 120° C. is at least $1.0\times10^3$ Pa and no greater than $1.0\times10^4$ Pa. A cross-linking density Nx represented by formula (1) is at least $2.9\times10^{-7}$ mol/cm$^3$ and no greater than $2.5\times10^{-6}$ mol/cm$^3$. A loss tangent tan δx represented by formula (2) is at least 0.05 and no greater than 0.50.

$$Nx=10\times Gx/R\times(T_{10000}+343) \quad (1)$$

In formula (1), Gx represents a storage elastic modulus [Pa] of the toner at a temperature of $T_{10000}$+70° C., R represents a gas constant, and $T_{10000}$ represents a temperature [° C.] at which the storage elastic modulus of the toner reaches $1.0\times10^4$ Pa.

$$\tan \delta x=Gy/Gx \quad (2)$$

In formula (2), Gx represents a storage elastic modulus [Pa] of the toner at a temperature of $T_{10000}$+70° C., Gy represents a loss elastic modulus [Pa] of the toner at a temperature of $T_{10000}$+70° C., and $T_{10000}$ represents a temperature [° C.] at which the storage elastic modulus of the toner reaches $1.0\times10^4$ Pa.

A method for producing an electrostatic latent image developing toner according to the present invention includes melt-kneading and pulverizing. In the melt-kneading, toner materials including at least a binder resin and a high-molecular cross-linking agent are melt-kneaded to give a melt-kneaded product. In the pulverizing, the melt-kneaded product is pulverized to give a pulverized product including a plurality of particles. The high-molecular cross-linking agent has a cross-linking functional group content of at least 1.0 mmol/g and no greater than 10.0 mmol/g. The high-molecular cross-linking agent has a mass average molecular weight of at least 10,000 and no greater than 150,000.

Advantageous Effects of Invention

The present invention can provide an electrostatic latent image developing toner that has viscoelasticity suitable for both low-temperature fixing and high-temperature fixing and that is excellent in all of low-temperature fixability, hot offset resistance, and heat-resistant preservability.

DESCRIPTION OF EMBODIMENTS

Figure 1:
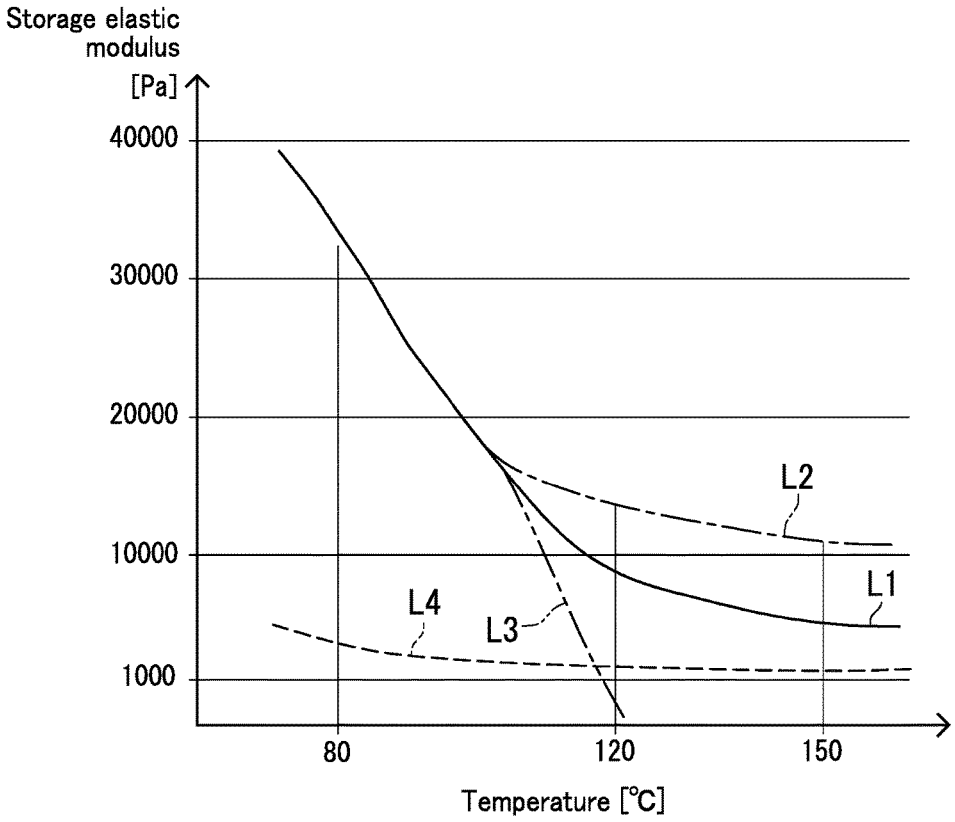
FIG. 1 is a graph for illustrating viscoelasticity of an electrostatic latent image developing toner according to an embodiment of the present invention.

The following describes an embodiment of the present invention. Unless otherwise stated, evaluation results (values indicating shape and physical properties) for a powder (specific examples include toner mother particles, external additive, and toner) are number averages of values measured for a suitable number of particles included in the powder.

A number average particle diameter of a powder is a number average value of equivalent circle diameters of primary particles of the powder (diameters of circles having the same areas as areas of projections of the particles) measured using a microscope, unless otherwise stated. A value for a volume median diameter ($D_{50}$) of a powder is measured using a laser diffraction/scattering particle size distribution analyzer ("LA-750", product of Horiba, Ltd.), unless otherwise stated. A value for a mass average molecular weight (Mw) is measured by gel permeation chromatography, unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) measured using the differential scanning calorimeter during the second heating, the glass transition point (Tg) corresponds to a temperature (onset temperature) at a point of change of specific heat (i.e., an intersection point of an extrapolation line of a base line and an extrapolation line of an inclined portion of the curve). A value for a softening point (Tm) is measured using a capillary rheometer ("CFT-500D", product of Shimadzu Corporation), unless otherwise stated. On an S-shaped curve (vertical axis: temperature, horizontal axis: stroke) measured using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) measured using a differential scanning calorimeter ("DSC-6220", product of Seiko Instruments Inc.), unless otherwise stated.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

A toner according to the present embodiment is for example suitable for use as a positively chargeable toner for developing an electrostatic latent image. The toner according to the present embodiment is a powder including a plurality of toner particles (particles each having the features described below). The toner may be used as a one-component developer. Alternatively, a two-component developer may be prepared by mixing the toner and a carrier using a mixer (for example, a ball mill). In order to achieve high quality image formation, a ferrite carrier (specifically, a powder of ferrite particles) is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, ferromagnetic material such as ferrite) or formed from a resin in which magnetic particles are dispersed. Alternatively, magnetic particles may be dispersed in resin layers coating carrier cores. Preferably, the amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction with a carrier therein.

The toner according to the present embodiment can for example be used in image formation in an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Next, a developing device (specifically, a developing device having a toner-containing developer loaded therein) of the electrophotographic apparatus supplies the toner to the photosensitive member to develop the electrostatic latent image formed on the photosensitive member. The toner is charged by friction with the carrier, a development sleeve, or a blade in the developing device before being supplied to the photosensitive member. For example, a positively chargeable toner is positively charged. In the developing step, the toner (specifically, the toner charged by friction) on the development sleeve (for example, a surface of a development roller in the developing device) disposed in the vicinity of the photosensitive member is supplied to the photosensitive member and caused to adhere to the electrostatic latent image on the photosensitive member, so that a toner image is formed on the photosensitive member. Toner is supplied to the developing device from a toner container containing toner for replenishment use to make up for consumed toner.

Subsequently, in a transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, a fixing device (fixing method: nip fixing with a heating roller and a pressure roller) of the electrophotographic apparatus fixes the toner to the recording medium by applying heat and pressure to the toner. As a result, an image is formed on the recording medium. A full-color image can for example be formed by superimposing toner images of four different colors: black, yellow, magenta, and cyan. A direct transfer process may alternatively be employed, which involves direct transfer of the toner image on the photosensitive member to the recording medium without the use of the intermediate transfer member. The fixing method may be belt fixing.

The toner according to the present embodiment includes a plurality of toner particles. The toner particles may include an external additive. In a configuration in which the toner particles include an external additive, the toner particles each include a toner mother particle and the external additive. The external additive adheres to a surface of each toner mother particle. The toner mother particles contain a binder resin. The toner mother particles may contain an internal additive (for example, at least one of a releasing agent, a colorant, a charge control agent, and a magnetic powder) in addition to the binder resin, as necessary. The external additive may be omitted if unnecessary. In a situation in which the external additive is omitted, the toner mother particles are equivalent to the toner particles.

The toner particles included in the toner according to the present embodiment may be toner particles having no shell layers (referred to below as non-capsule toner particles) or may be toner particles having shell layers (referred to below as capsule toner particles). In each of the capsule toner particles, a toner mother particle includes a core and a shell layer covering a surface of the core. The shell layer is substantially composed of a resin. Both heat-resistant preservability and low-temperature fixability of the toner can be achieved for example by using low-melting cores and covering each core with a highly heat-resistant shell layer. An additive may be dispersed in the resin forming the shell layer. The shell layer may entirely cover the surface of each core or partially cover the surface of each core. The shell layer may be substantially composed of a thermosetting resin, may be substantially composed of a thermoplastic resin, or may contain both a thermoplastic resin and a thermosetting resin. The shell layer may be formed by any method. For example, the shell layer may be formed according to an in-situ polymerization process, an in-liquid curing film coating process, or a coacervation process.

The toner according to the present embodiment is an electrostatic latent image developing toner having the following features (referred to below as basic features).

(Basic Features of Toner)

The electrostatic latent image developing toner includes a plurality of toner particles containing a binder resin. The toner particles have a cross-linking structure originating from a high-molecular cross-linking agent. A storage elastic modulus of the toner at a temperature of 80° C. (referred to below as storage elastic modulus $G'_{80}$) is at least $1.0\times10^3$ Pa and no greater than $5.0\times10^4$ Pa. A storage elastic modulus of the toner at a temperature of 120° C. (referred to below as storage elastic modulus $G'_{120}$) is at least $1.0\times10^3$ Pa and no greater than $1.0\times10^4$ Pa. A cross-linking density Nx represented by formula (1) shown below is at least $2.9\times10^{-7}$ mol/cm$^3$ and no greater than $2.5\times10^{-6}$ mol/cm$^3$. A loss tangent tan δx represented by formula (2) shown below is at least 0.05 and no greater than 0.50. The storage elastic modulus, the cross-linking density Nx, and the loss tangent tan δx are measured by the same methods as those employed in Examples described below or by alternative methods.

$$Nx=10\times Gx/R\times(T_{10000}+343) \quad (1)$$

In formula (1), Gx represents a storage elastic modulus [Pa] of the toner at a temperature of $T_{10000}$+70° C., R represents a gas constant, and $T_{10000}$ represents a temperature [° C.] at which the storage elastic modulus of the toner reaches $1.0\times10^4$ Pa.

$$\tan\delta x=Gy/Gx \quad (2)$$

In formula (2), Gx represents a storage elastic modulus [Pa] of the toner at a temperature of $T_{10000}$+70° C., Gy represents a loss elastic modulus [Pa] of the toner at a temperature of $T_{10000}$+70° C., and $T_{10000}$ represents a temperature [° C.] at which the storage elastic modulus of the toner reaches $1.0\times10^4$ Pa.

The gas constant is $8.31\times10^7$ dyne·cm/mol·K.

A toner that can be reliably fixed by low-temperature fixing and that can be fixed by high-temperature fixing without causing hot offset (toner adhering to a heating roller) is preferably used for nip fixing. More specifically, it is preferable that the toner for nip fixing is appropriately fixable both by low-temperature fixing using a heating roller at a temperature of approximately 120° C. (temperature of an unheated pressure roller: approximately 80° C.) and by high-temperature fixing using a heating roller at a temperature of approximately 150° C. (temperature of an unheated pressure roller: approximately 120° C.). Fixing of such a toner can be performed over a wide temperature range.

The present inventor confirmed through experiments and the like that the toner for nip fixing is somewhat influenced by affinity between the binder resin and a recording medium (for example, paper) but basically behaves as described below.

In a situation in which the toner is heated on a recording medium (for example, printing paper) to reduce the storage elastic modulus of the toner, the toner is fixed to the recording medium when the storage elastic modulus of the toner has reached a specific level (referred to below as fixable level) or lower. Specifically, the present inventor found that the toner is favorably fixed to a recording medium by low-temperature fixing (temperature of pressure roller: approximately 80° C.) when the storage elastic modulus of the toner has reached $5.0\times10^4$ Pa or lower and that the toner is favorably fixed to a recording medium by high-temperature fixing (temperature of pressure roller: approximately 120° C.) when the storage elastic modulus of the toner has reached $1.0\times10^4$ Pa or lower. However, the toner loses its self-aggregation ability to cause hot offset when the storage elastic modulus of the toner is further reduced to be lower than $1.0\times10^3$ Pa (also referred to below as H.O. level).

The toner having the above-described features has the following feature (A).

(A) The storage elastic modulus $G'_{80}$ is at least $1.0\times10^3$ Pa and no greater than $5.0\times10^4$ Pa, and the storage elastic modulus $G'_{120}$ is at least $1.0\times10^3$ Pa and no greater than $1.0\times10^4$ Pa.

The storage elastic modulus of the toner having the above-described basic features decreases to the fixable level but does not decrease to be lower than the H.O. level ($1.0\times10^3$ Pa) both in low-temperature fixing (temperature of pressure roller: 80° C.) and in high-temperature fixing (temperature of pressure roller: 120° C.). It is therefore thought that the toner having the above-described features tends not to cause hot offset and can be appropriately fixed to a recording medium (for example, paper) both in low-temperature fixing and in high-temperature fixing. Preferably, a storage elastic modulus of the toner at a temperature of 150° C. (also referred to below as storage elastic modulus $G'_{150}$) is at least $1.0\times10^2$ Pa in order to prevent toner hot offset more reliably.

When heated, a sharp-melting toner starts sharp-melting at a sharp-melting onset temperature (for example, a temperature lower than 80° C.), and the storage elastic modulus of the toner rapidly decreases during sharp-melting. In a situation in which the toner is further heated, the amount of change in storage elastic modulus of the toner (the magnitude of a decrease in storage elastic modulus with an increase in temperature) decreases with an increase in temperature of the toner to eventually reach a saturation point, and then the storage elastic modulus does not change with an increase in temperature. The following describes temperature dependence curves for the storage elastic modulus of the toner (vertical axis: storage elastic modulus, horizontal axis: temperature) with reference to FIG. 1. In FIG. 1, curves L1, L2, and L3 exhibit the same characteristics as one another at temperatures lower than approximately 100° C. but exhibit different characteristics from one another at higher temperatures. A temperature dependence curve for the storage elastic modulus of the toner is also referred to below as "G' temperature dependence curve".

On the curve L1 in FIG. 1, the storage elastic modulus $G'_{80}$ is in the range of from $1.0\times10^3$ Pa to $5.0\times10^4$ Pa, and the storage elastic modulus $G'_{120}$ and the storage elastic modulus $G'_{150}$ are each in the range of from $1.0\times10^3$ Pa to $1.0\times10^4$ Pa.

On the curve L2 in FIG. 1, the storage elastic modulus $G'_{80}$ is in the range of from $1.0\times10^3$ Pa to $5.0\times10^4$ Pa, and the storage elastic modulus $G'_{120}$ and the storage elastic modulus $G'_{150}$ are each greater than $1.0\times10^4$ Pa. In a situation in which the storage elastic modulus $G'_{120}$ of the toner is greater than $1.0\times10^4$ Pa, the toner tends to show insufficient fixability in high-temperature fixing.

On the curve L3 in FIG. 1, the storage elastic modulus $G'_{80}$ is in the range of from $1.0\times10^3$ Pa to $5.0\times10^4$ Pa, and the storage elastic modulus $G'_{120}$ is less than $1.0\times10^3$ Pa. In a situation in which the storage elastic modulus $G'_{120}$ of the toner is less than $1.0\times10^3$ Pa, the toner tends to easily cause hot offset in high-temperature fixing.

On the curve L4 in FIG. 1, the storage elastic modulus $G'_{80}$, the storage elastic modulus $G'_{120}$, and the storage elastic modulus $G'_{150}$ are each in the range of from $1.0\times10^3$ Pa to $1.0\times10^4$ Pa. The storage elastic modulus of the toner having a characteristic such as represented by the curve L4 tends to reach $1.0\times10^4$ Pa in a temperature range lower than 80° C.

In a situation in which the G' temperature dependence curve of the toner is the curve L1 or the curve L4 in FIG. 1, the storage elastic modulus of the toner decreases to $5.0\times10^4$ Pa (fixable level) at a temperature of 80° C. but does not decrease to be lower than $1.0\times10^3$ Pa (H.O. level) even if the toner is heated to 120° C. It is therefore thought that the toner having a characteristic such as represented by the curve L1 or the curve L4 in FIG. 1 tends not to cause hot offset and can be appropriately fixed to a recording medium (for example, paper) both in low-temperature fixing and in high-temperature fixing.

In order to obtain a toner that has the above-described feature (A) and that is excellent in low-temperature fixability, hot offset resistance, heat-resistant preservability, and producibility, the present inventor made a detailed study to arrive at a toner having the following features (B) to (D) in addition to the above-described feature (A) (i.e., the toner having the above-described features).

(B) The toner particles have a cross-linking structure originating from a high-molecular cross-linking agent.

(C) The cross-linking density Nx of the toner is at least $2.9\times10^{-7}$ mol/cm$^3$ and no greater than $2.5\times10^{-6}$ mol/cm$^3$.

(D) The loss tangent tan δx of the toner is at least 0.05 and no greater than 0.50.

The cross-linking density Nx indicates the number of cross-linking points per unit volume in a resin. Hot offset resistance and heat-resistant preservability of the toner tend to improve with an increase in cross-linking density Nx of the toner. However, in a situation in which the toner has a too high cross-linking density Nx, the toner tends to have poor low-temperature fixability.

The loss tangent tan δx indicates viscoelasticity of a resin. Specifically, a resin having a greater loss tangent tan δx has a higher viscosity. Low-temperature fixability of the toner tends to improve with an increase in loss tangent tan δx of the toner. However, in a situation in which the toner has a too large loss tangent tan δx, the toner tends to have poor hot offset resistance and poor heat-resistant preservability. In a situation in which the toner has a too low loss tangent tan δx, the storage elastic modulus $G'_{80}$ of the toner exceeds $5.0\times10^4$ Pa and the toner tends to show insufficient fixability in low-temperature fixing.

The present inventor succeeded in achieving suitable values with respect to the cross-linking density Nx and the loss tangent tan δx by using a high-molecular cross-linking agent. Specifically, it is possible to form a low-density cross-linking structure (specifically, a cross-linking structure in which distances between cross-linking points are long) in the toner particles while ensuring sufficient elasticity of the toner by cross-linking a resin in the toner particles to an appropriate degree using a high-molecular cross-linking agent. As a result of the toner particles having a low-density cross-linking structure, sufficient low-temperature fixability of the toner is easily ensured. By contrast, in a situation in which a low-density cross-linking structure is formed in the toner particles using a low-molecular cross-linking agent, the toner tends to have too high viscosity and insufficient elasticity. As a result of the toner having insufficient elasticity, the toner tends to have insufficient hot offset resistance and insufficient heat-resistant preservability. The following describes a difference between a high-molecular cross-linking agent and a low-molecular cross-linking agent with reference to FIGS. 2 and 3.

Figure 2:
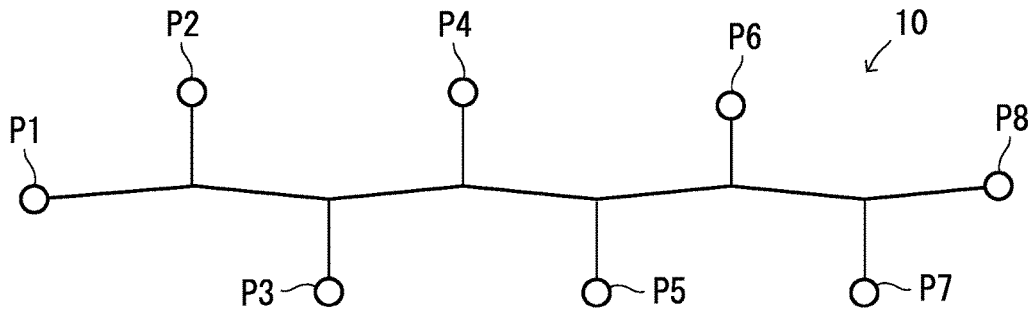
FIG. 2 is a diagram for illustrating a high-molecular cross-linking agent.
Figure 3:
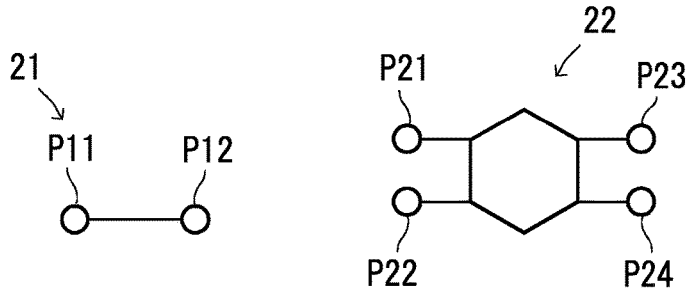
FIG. 3 is a diagram for illustrating a low-molecular cross-linking agent.

FIG. 2 is a diagram schematically illustrating an example of a high-molecular cross-linking agent (high-molecular cross-linking agent 10). Bonds P1 to P8 in FIG. 2 represent cross-linking bonds of the high-molecular cross-linking agent 10. FIG. 3 is a diagram schematically illustrating two different commonly-used low-molecular cross-linking agents (low-molecular cross-linking agent 21: a bifunctional aliphatic compound, low-molecular cross-linking agent 22: a tetrafunctional aromatic compound). In FIG. 3, the bonds P11 and P12 represent cross-linking bonds of the low-molecular cross-linking agent 21, and bonds P21 to P24 represent cross-linking bonds of the low-molecular cross-linking agent 22.

The high-molecular cross-linking agent 10 has more cross-linking bonds than the low-molecular cross-linking agents 21 and 22. The low-molecular cross-linking agents 21 and 22 each have fewer cross-linking bonds, and distances between the bonds are short. Appropriately cross-linking a resin using the high-molecular cross-linking agent 10 gives the resin a cross-linking structure in which distances between cross-linking points are long. For example, two of the bonds P1 to P8 contribute to cross-linking. The distance between cross-linking points is long in a situation in which the bonds P1 and P8 contribute to the cross-linking. The distance between cross-linking points is short in a situation in which the bonds P1 and P2 contribute to the cross-linking. Basically, bonds contributing to cross-linking are determined at random. In terms of the entire resin, on average, distances between cross-linking points tend to be longer in a situation in which a high-molecular cross-linking agent is used than in a situation in which a low-molecular cross-linking agent is used. However, distances between cross-linking points in a situation in which a high-molecular cross-linking agent is used tend to be as short as in a situation in which a low-molecular cross-linking agent is used, if the resin is excessively cross-linked. For example, if all the bonds P1 to P8 of the high-molecular cross-linking agent 10 contribute to cross-linking, distances between cross-linking points are short, unlike the above-described case of cross-linking only by bonds distant from each other (for example, cross-linking by the bonds P1 and P8).

Preferably, the high-molecular cross-linking agent according to the above-described basic features is a copolymer of at least one vinyl compound having a cross-linking functional group and at least one vinyl compound having no cross-linking functional group. The amount of the cross-linking functional group in such a high-molecular cross-linking agent can be readily adjusted by changing conditions such as a compounding ratio between the vinyl compound having a cross-linking functional group and the vinyl compound having no cross-linking functional group, types of the vinyl compounds, or polymerization conditions. It is thought that repeating units derived from the vinyl compounds form the polymer of the vinyl compounds by addition polymerization through carbon-to-carbon double bonds "C═C". A vinyl compound refers to a compound having a vinyl group ($CH_2$═CH—) or a substituted vinyl group in which hydrogen is replaced. Examples of vinyl compounds include ethylene, propylene, butadiene, vinyl chloride, acrylic acid, acrylic acid ester, methacrylic acid, methacrylic acid ester, acrylonitrile, and styrene.

Particularly preferably, a high-molecular cross-linking agent having either or both of an oxazoline group and a glycidyl group as a cross-linking functional group is used as a high-molecular cross-linking agent for forming a low-density cross-linking structure (network structure) in the toner particles containing a non-crystalline polyester resin.

The following describes an example of a high-molecular cross-linking agent having an oxazoline group and an example of a high-molecular cross-linking agent having a glycidyl group in the stated order.

Particularly preferably, the high-molecular cross-linking agent having an oxazoline group is a high-molecular cross-linking agent including a repeating unit represented by formula (1-1) shown below. The repeating unit represented by formula (1-1) is referred to below as a "repeating unit (1-1)". The repeating unit (1-1) is derived from a vinyl compound having an oxazoline group (cross-linking functional group). As the high-molecular cross-linking agent including the repeating unit (1-1), for example, an aqueous solution of an oxazoline group-containing polymer ("EPOCROS (registered Japanese trademark) WS series", product of Nippon Shokubai Co., Ltd.) can be used. "EPOCROS WS-300" contains a copolymer of 2-vinyl-2-oxazoline and methyl methacrylate. "EPOCROS WS-700" contains a copolymer of 2-vinyl-2-oxazoline, methyl methacrylate, and butyl acrylate.

[Formula 1]

(1-1)

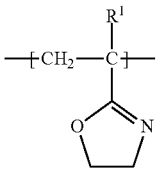

In formula (1-1), $R^1$ represents a hydrogen atom or an optionally substituted alkyl group (straight-chain, branched, or cyclic). Particularly preferably, $R^1$ is a hydrogen atom or a methyl group. In the case of a repeating unit derived from 2-vinyl-2-oxazoline, for example, $R^1$ in formula (1-1) represents a hydrogen atom.

The repeating unit (1-1) has a non-ring-opened oxazoline group. The non-ring-opened oxazoline group is reactive with a carboxyl group, an aromatic sulfanyl group, and an aromatic hydroxyl group. For example, the repeating unit (1-1) reacts with a carboxyl group of a polyester resin (represented by $R^2$ in formula (1-2)). Through this reaction, the oxazoline group is opened up and a cross-linking structure is formed in the polyester resin as shown in formula (1-2) below.

[Formula 2]

(1-2)

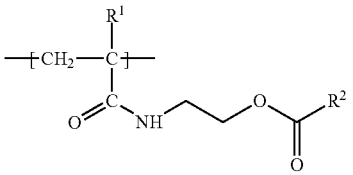

In order to obtain a toner that is excellent in all of low-temperature fixability, hot offset resistance, and heat-resistant preservability, it is preferable that the toner particles contain a polyester resin having ester linkages and a polymer including the repeating unit (1-1), and the polyester resin and the polymer including the repeating unit (1-1) are bonded to each other in a manner represented by formula (1-2) through opening of oxazoline groups of at least some molecules of the repeating unit (1-1) in the polymer. In order to obtain a toner that is excellent in positive chargeability, it is preferable that the binder resin of the toner particles includes the repeating unit (1-1) and a repeating unit (1-2), and $R^1$ in the repeating unit (1-2) represents the same group as $R^1$ in formula (1-1) and "$R^2$—COO—" in the repeating unit (1-2) represents an end of an acid component of the polyester resin in the toner particles.

Particularly preferably, the high-molecular cross-linking agent having a glycidyl group is a high-molecular cross-linking agent including a repeating unit represented by formula (2-1) shown below. The repeating unit represented by formula (2-1) is referred to below as a "repeating unit (2-1)". The repeating unit (2-1) is derived from a vinyl compound having a glycidyl group (cross-linking functional group).

[Formula 3]

(2-1)

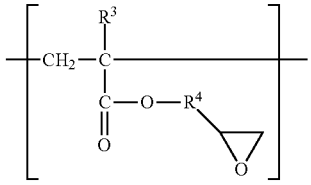

In formula (2-1), $R^3$ represents a hydrogen atom or an optionally substituted alkyl group (straight-chain, branched, or cyclic). Particularly preferably, $R^3$ is a hydrogen atom or a methyl group. $R^4$ represents an optionally substituted alkylene group. Particularly preferably, $R^4$ represents an alkylene group having a carbon number of at least 1 and no greater than 4. In the case of a repeating unit derived from glycidyl methacrylate, for example, $R^3$ represents a methyl group and $R^4$ represents a methylene group in formula (2-1).

The repeating unit (2-1) has a glycidyl group. The glycidyl group is reactive with a carboxyl group, an amino group, and an aromatic hydroxyl group. For example, the repeating unit (2-1) reacts with a carboxyl group of a polyester resin (represented by $R^5$ in formula (2-2)). Through this reaction, the glycidyl group is opened up and a cross-linking structure is formed in the polyester resin as shown in formula (2-2) below.

[Formula 4]

(2-2)

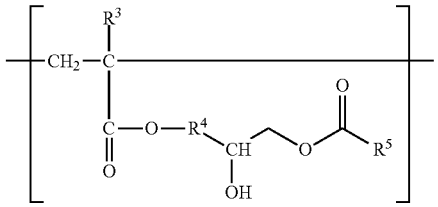

In order to obtain a toner that is excellent in all of low-temperature fixability, hot offset resistance, and heat-resistant preservability, it is preferable that the toner particles contain a polyester resin having ester linkages and a polymer including the repeating unit (2-1), and the polyester resin and the polymer including the repeating unit (2-1) are bonded to each other in a manner represented by formula (2-2) through opening of glycidyl groups of at least some molecules of the repeating unit (2-1) in the polymer. In order to obtain a toner that is excellent in positive chargeability, it is particularly preferable that the binder resin of the toner particles includes the repeating unit (2-1) and a repeating unit (2-2), and $R^3$ and $R^4$ in the repeating unit (2-2) respectively represent the same groups as $R^3$ and $R^4$ in formula (2-1) and "$R^5$—COO—" in the repeating unit (2-2) represents an end of an acid component of the polyester resin in the toner particles.

In order to achieve suitable values with respect to the cross-linking density Nx and the loss tangent tan δx using a high-molecular cross-linking agent, the cross-linking functional group content of the high-molecular cross-linking agent according to the above-described features is preferably at least 1.0 mmol/g and no greater than 10.0 mmol/g, and the mass average molecular weight (Mw) of the high-molecular cross-linking agent is preferably at least 10,000 and no greater than 150,000.

In order to achieve suitable values with respect to the cross-linking density Nx and the loss tangent tan δx using a high-molecular cross-linking agent, the toner preferably has the following feature (E) in addition to the above-described features (A) to (D).

(E) Tetrahydrofuran insolubles (THF insolubles) account for at least 0.01% by mass and no greater than 0.50% of the toner.

The amount of THF insolubles (specifically, gels insoluble in tetrahydrofuran) indicates the amount of cross-linking sites in the resin (degree of cross-linking). The cross-linking density Nx of the toner tends to increase and the loss tangent tan δx of the toner tends to decrease with an increase in the amount of the THF insolubles in the toner (specifically, mass percentage thereof in the toner). Hot offset resistance and heat-resistant preservability of the toner tend to improve with an increase in the amount of the THF insolubles in the toner. However, in a situation in which the amount of the THF insolubles in the toner is too large, the toner tends to have poor fixability. Note that the amount of the THF insolubles in the toner is measured by the same method as that employed in Examples described below or by an alternative method.

In order to achieve an appropriate value with respect to the amount of the THF insolubles (see feature (E)) in the toner having the above-described basic features, it is preferable that the toner particles contain different non-crystalline polyester resins as the binder resin, and the toner particles are a kneaded and pulverized product including at least the different non-crystalline polyester resins and the high-molecular cross-linking agent.

In order to achieve both heat-resistant preservability and low-temperature fixability of the toner, it is preferable that the toner particles contain a non-crystalline polyester resin having a softening point of less than 100° C. and a non-crystalline polyester resin having a softening point of at least 120° C., and that each of the different non-crystalline polyester resins contained in the toner particles contains at least one bisphenol as an alcohol component. It is more preferable that each of the different non-crystalline polyester resins contained in the toner particles further contains an aromatic dicarboxylic acid (for example, terephthalic acid) as an acid component. As a result of using such different non-crystalline polyester resins, the toner having the above-described feature (A) is easily obtained. The softening point (Tm) of a resin can for example be adjusted by changing the molecular weight of the resin. The molecular weight of a resin can be adjusted by changing conditions for polymerization of the resin (specific examples include amount of a polymerization initiator to use, polymerization temperature, and polymerization time).

In order to uniformly form a low-density cross-linking structure derived from the above-described high-molecular cross-linking agent in the toner particles, the toner particles in the toner having the above-described basic features preferably contain no crystalline polyester resin. The above-described basic features of the toner can ensure that the toner is sufficiently sharp-melting even if the toner particles contain no crystalline polyester resin.

In order to obtain a toner suitable for image formation, the toner mother particles preferably have a volume median diameter ($D_{50}$) of at least 4 μm and no greater than 9 μm.

The following describes a preferable example of a composition of non-capsule toner particles. The toner mother particles and the external additive are described in the stated order. Non-essential components may be omitted in accordance with the intended use of the toner. The following toner mother particles of the non-capsule toner particles can be used as cores for capsule toner particles.

[Toner Mother Particles]

(Binder Resin)

The binder resin is typically a main component (for example, at least 80% by mass) of the toner mother particles. Accordingly, properties of the binder resin are thought to have a great influence on overall properties of the toner mother particles. Properties (specific examples include hydroxyl value, acid value, Tg, and Tm) of the binder resin can be adjusted by using different resins in combination for the binder resin. The toner mother particles have a higher tendency to be anionic in a situation in which the binder resin has an ester group, an ether group, an acid group, or a methyl group, and have a higher tendency to be cationic in a situation in which the binder resin has an amino group or an amide group.

Preferably, the binder resin is a non-crystalline polyester resin or a non-crystalline styrene-acrylic acid-based resin. Particularly preferably, the binder resin is a non-crystalline polyester resin.

A polyester resin can be synthesized through polycondensation of at least one polyhydric alcohol (specific examples include diols, bisphenols, and tri- or higher-hydric alcohols shown below) with at least one polycarboxylic acid (specific examples include di-, tri-, and higher-basic carboxylic acids shown below).

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A first preferable example of the non-crystalline polyester resin is a polymer of at least one bisphenol (specific examples include bisphenol A ethylene oxide adduct and bisphenol A propylene oxide adduct) and at least one aromatic dicarboxylic acid (for example, terephthalic acid). A second preferable example of the non-crystalline polyester resin is a polymer of at least one bisphenol (for example, two bisphenols: bisphenol A ethylene oxide adduct and bisphenol A propylene oxide adduct), at least one aromatic dicarboxylic acid (for example, terephthalic acid), and at least one α,ω-alkanedicarboxylic acid (for example, adipic acid). A third preferable example of the non-crystalline polyester resin is a polymer of at least one bisphenol (for example, two bisphenols: bisphenol A ethylene oxide adduct and bisphenol A propylene oxide adduct), at least one aromatic dicarboxylic acid (for example, terephthalic acid), at least one α,ω-alkane dicarboxylic acid (for example, adipic acid), and at least one tri- or higher-basic carboxylic acid (for example, trimellitic acid). In the case of the third preferable example of the non-crystalline polyester resin, the non-crystalline polyester resin tends to have a high softening point (for example, a non-crystalline polyester resin having a softening point of at least 120° C.). Specifically, it is thought that the resin is cross-linked by the tri- or higher-basic carboxylic acid.

In order to improve low-temperature fixability of the toner, the toner mother particles may contain a crystalline polyester resin (for example, a crystalline polyester resin having a crystallinity index of at least 0.90 and no greater than 1.15). However, it is thought that the above-described basic features can ensure that the toner can have sufficient low-temperature fixability even if the toner mother particles contain no crystalline polyester resin. The crystallinity index of a resin is equivalent to a ratio (=Tm/Mp) of the softening point (Tm) of the resin to the melting point (Mp) of the resin. Typically, a non-crystalline resin has Tm and Mp that differ greatly. Mp of a non-crystalline polyester resin is often indeterminable.

A styrene-acrylic acid-based resin is a copolymer of at least one styrene-based monomer and at least one acrylic acid-based monomer. Examples of styrene-based monomers and acrylic acid-based monomers that can be preferably used for synthesis of the styrene-acrylic acid-based resin are listed below.

Examples of preferable styrene-based monomers include styrene, alkylstyrenes (specific examples include α-methylstyrene, p-ethylstyrene, and 4-tert-butylstyrene), p-hydroxystyrene, m-hydroxystyrene, α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth)acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth)acrylate.

(Colorant)

The toner mother particles may contain a colorant. A known pigment or dye matching a color of the toner can be used as a colorant. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent is for example used in order to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax. One releasing agent may be used independently, or two or more releasing agents may be used in combination.

In order to improve compatibility between the binder resin and the releasing agent, a compatibilizer may be added to the toner mother particles.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent. The cationic strength of the toner mother particles can be increased through the toner mother particles containing a positively chargeable charge control agent. However, when it is ensured that the toner has sufficient chargeability, the toner mother particles do not need to contain a charge control agent.

(Magnetic Powder)

The toner mother particles may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

[External Additive]

An external additive (specifically, a powder of external additive particles) may be caused to adhere to the surfaces of the toner mother particles. Unlike internal additives, the external additive is not to be present inside of the toner mother particles but to be selectively present only on the surfaces of the toner mother particles (surface portions of the toner particles). The external additive is for example caused to adhere to the surfaces of the toner mother particles by stirring the toner mother particles (powder) and the external additive (powder) together. The toner mother particles and the external additive particles do not chemically react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

In order to allow the external additive to sufficiently exhibit its function while preventing detachment of the external additive particles from the toner particles, the amount of the external additive (in a situation in which plural types of external additive particles are used, a total amount of the external additive particles) is preferably at least 0.5 part by mass and no greater than 10 parts by mass relative to 100 parts by mass of the toner mother particles.

External additive particles are preferably inorganic particles, and particularly preferably silica particles or particles of a metal oxide (specific examples include alumina, titanium oxide, magnesium oxide, zinc oxide, strontium titanate, and barium titanate). However, particles of an organic acid compound such as a fatty acid metal salt (specific examples include zinc stearate) or resin particles may be used as the external additive particles. Alternatively or additionally, composite particles, which are particles of a composite of a plurality of materials, may be used as the external additive particles. The external additive particles may be surface-treated. One type of external additive particles may be used independently, or two or more types of external additive particles may be used in combination.

[Toner Production Method]

In order to produce the toner having the above-described basic features easily and favorably, for example, a method for producing the toner preferably includes a melt-kneading process and a pulverization process described below. More preferably, the method for producing the toner includes a classification process and an external additive addition process described below.

(Melt-Kneading Process)

The following describes an example of the melt-kneading process. In the melt-kneading process, toner materials including at least a binder resin and a high-molecular cross-linking agent (for example, different non-crystalline polyester resins, a high-molecular cross-linking agent, a colorant, and a releasing agent) are mixed, and the resultant mixture is melt-kneaded to give a melt-kneaded product. A mixer (for example, an FM mixer) can be suitably used for mixing the toner materials. A twin-screw extruder, a three-roll kneader, or a two-roll kneader can be suitably used for melt-kneading the mixture. In order to obtain the toner having the above-described basic features, it is preferable to use a high-molecular cross-linking agent having a cross-linking functional group content of at least 1.0 mmol/g and no greater than 10.0 mmol/g and a mass average molecular weight (Mw) of at least 10,000 and no greater than 150,000. Additionally or alternatively, a masterbatch including a binder resin and a colorant may be used for the toner materials.

(Pulverization Process)

Subsequently, the resultant melt-kneaded product is pulverized to give a pulverized product including a plurality of particles. For example, the melt-kneaded product is cooled to solidify using a cooling and solidifying device (specific examples include a drum flaker). Subsequently, the resultant solidified product is coarsely pulverized using a first pulverizer. Thereafter, the resultant coarsely pulverized product is further pulverized using a second pulverizer.

(Classification Process)

Subsequently, the resultant pulverized product is classified using a classifier (for example, an air classifier). Through the above, toner mother particles having a desired particle diameter are obtained.

(External Additive Addition Process)

In the external additive addition process, an external additive is caused to adhere to the surfaces of the toner mother particles. The external additive can be caused to adhere to the surfaces of the toner mother particles by mixing the toner mother particles and the external additive using a mixer under conditions that prevent the external additive from being embedded in the toner mother particles.

Through the above-described processes, a toner including a large number of toner particles can be produced. Note that non-essential processes may be omitted. In a situation in which a commercially available product can be used as is as a material, for example, a process of preparing the material can be omitted by using the commercially available product. In a situation in which an external additive is not caused to adhere to the surfaces of the toner mother particles (i.e., the external additive addition process is omitted), the toner mother particles are equivalent to the toner particles. In order to obtain a specific compound, a salt, an ester, a hydrate, or an anhydride of the compound may be used as a material thereof. Preferably, a large number of the toner particles are formed at the same time in order to produce the toner efficiently. Toner particles that are produced at the same time are thought to have substantially the same structure as one another.

EXAMPLES

The following describes Examples of the present invention. Table 1 shows toners (electrostatic latent image developing toners) TA-1 to TA-7 and TB-1 to TB-9 according to Examples and Comparative Examples. Table 2 shows cross-linking agents CL-1 to CL-9 that were used for production of the toners shown in Table 1.

TABLE 1

| | Binder resin (PES) | | Cross-linking agent | |
|---|---|---|---|---|
| Toner | Type | Amount [part by mass] | Type | Amount [part by mass] |
| TA-1 | B/C | 60/20 | CL-1 | 1.0 |
| TA-2 | B/C | 60/20 | CL-1 | 2.0 |
| TA-3 | A/C | 60/20 | CL-1 | 1.0 |
| TA-4 | A/C | 40/40 | CL-1 | 1.0 |
| TA-5 | A/C | 40/40 | CL-2 | 1.0 |
| TA-6 | A/C | 40/40 | CL-3 | 1.0 |
| TA-7 | A/C | 40/40 | CL-4 | 1.0 |
| TB-1 | A/C | 40/40 | CL-7 | 1.0 |
| TB-2 | A/C | 40/40 | CL-7 | 1.0 |
| TB-3 | A/C | 40/40 | CL-8 | 1.0 |
| TB-4 | A/C | 40/40 | CL-9 | 1.0 |
| TB-5 | A/C | 40/40 | CL-5 | 1.0 |
| TB-6 | A/C | 40/40 | CL-6 | 1.0 |
| TB-7 | B/C | 60/20 | CL-6 | 1.0 |
| TB-8 | A/C | 40/40 | CL-1 | 4.0 |
| TB-9 | A/C | 40/40 | CL-1 | 0.1 |

TABLE 2

| Cross-linking agent | High-molecular/ Low-molecular | Mw | Cross-linking functional group Type | Amount [mmol/g] |
|---|---|---|---|---|
| CL-1 | High-molecular | 40000 | Oxazoline group | 4.5 |
| CL-2 | High-molecular | 120000 | Oxazoline group | 7.7 |
| CL-3 | High-molecular | 17000 | Glycidyl group | 9.2 |
| CL-4 | High-molecular | 140000 | Glycidyl group | 1.3 |
| CL-5 | High-molecular | 2300 | Isocyanate group | 1.3 |
| CL-6 | High-molecular | 6000 | Isocyanate group | 0.5 |
| CL-7 | Low-molecular | 192 | Carboxyl group | 15.6 |
| CL-8 | Low-molecular | 218 | Carboxyl group | 18.3 |
| CL-9 | Low-molecular | 140 | Oxazoline group | 14.3 |

The following describes a production method, evaluation methods, and evaluation results of the toners TA-1 to TA-7 and TB-1 to TB-9 in the stated order. In evaluations in which errors might occur, an evaluation value was calculated by obtaining an appropriate number of measured values and calculating the arithmetic mean of the measured values in order to ensure that any errors were sufficiently small.

[Preparation of Materials]

(Synthesis of Non-Crystalline Polyester Resin PES-A)

A four-necked flask having a capacity of 10 L and equipped with a thermometer, a glass nitrogen inlet tube, a stirrer (stainless steel stirring impeller), and a falling-type condenser (heat exchanger) was charged with 200 g of an adduct of bisphenol A with 2 moles of ethylene oxide (EO), 90 g of terephthalic acid, and 54 g of tin(II) 2-ethylhexanoate. Subsequently, a nitrogen atmosphere (inert atmosphere) was maintained in the flask with nitrogen gas introduced into the flask through the nitrogen inlet tube. Subsequently, the flask contents were heated up to 235° C. under stirring in the nitrogen atmosphere. The flask contents were then caused to react (polycondensation reaction) at a temperature of 235° C. in the nitrogen atmosphere while the flask contents were stirred until all the resin raw materials (adduct of bisphenol A with 2 moles of EO and terephthalic acid) melted. Subsequently, the internal pressure of the flask was reduced, and the flask contents were caused to react at a temperature of 235° C. in the reduced pressure atmosphere (pressure 8.0 kPa) until Tm of a reaction product (polyester resin) was a specific temperature (90° C.). As a result, a non-crystalline polyester resin PES-A having a glass transition point (Tg) of 60° C. and a softening point (Tm) of 90° C. was obtained.

(Synthesis of Non-Crystalline Polyester Resin PES-B)

A non-crystalline polyester resin PES-B was synthesized according to the same method as the synthesis method of the non-crystalline polyester resin PES-A in all aspects other than that 100 g of an adduct of bisphenol A with 2 moles of ethylene oxide (EO), 100 g of an adduct of bisphenol A with 2 moles of propylene oxide (PO), 60 g of terephthalic acid, and 20 g of adipic acid were used instead of 200 g of an adduct of bisphenol A with 2 moles of EO and 90 g of terephthalic acid. The resultant non-crystalline polyester resin PES-B had a glass transition point (Tg) of 40° C. and a softening point (Tm) of 90° C.

(Synthesis of Non-Crystalline Polyester Resin PES-C)

A four-necked flask having a capacity of 10 L and equipped with a thermometer, a glass nitrogen inlet tube, a stirrer (stainless steel stirring impeller), and a falling-type condenser (heat exchanger) was charged with 100 g of an adduct of bisphenol A with 2 moles of ethylene oxide (EO), 100 g of an adduct of bisphenol A with 2 moles of propylene oxide (PO), 60 g of terephthalic acid, 20 g of adipic acid, and 54 g of tin(II) 2-ethylhexanoate. Subsequently, a nitrogen atmosphere (inert atmosphere) was maintained in the flask with nitrogen gas introduced into the flask through the nitrogen inlet tube. Subsequently, the flask contents were heated up to 235° C. under stirring in the nitrogen atmosphere. The flask contents were then caused to react (polycondensation reaction) at a temperature of 235° C. in the nitrogen atmosphere while the flask contents were stirred until all the resin raw materials (adduct of bisphenol A with 2 moles of EO and terephthalic acid) melted. Subsequently, the internal pressure of the flask was reduced, and the flask contents were caused to further react (specifically, polymerization reaction) for 1.5 hours (90 minutes) at a temperature of 235° C. in the reduced pressure atmosphere (pressure 8.0 kPa).

Subsequently, the internal temperature of the flask was reduced to 210° C., and the flask contents were caused to react through addition of 380 g (2 mol) of trimellitic anhydride into the flask at a temperature of 210° C. in the reduced pressure atmosphere (pressure 8.0 kPa) until Tm of a reaction product (cross-linked polyester resin) was a specific temperature (140° C.). As a result, a non-crystalline polyester resin PES-C having a glass transition point (Tg) of 60° C. and a softening point (Tm) of 140° C. was obtained.

(Preparation of Cross-linking Agent CL-1)

An aqueous solution of an oxazoline group-containing polymer ("EPOCROS WS-700", product of Nippon Shokubai Co., Ltd., solid concentration: 25% by mass, Tg: 50° C.) was prepared as the cross-linking agent CL-1.

(Preparation of Cross-Linking Agent CL-2)

An aqueous solution of an oxazoline group-containing polymer ("EPOCROS WS-300", product of Nippon Shokubai Co., Ltd., solid concentration: 10% by mass, Tg: 90° C.) was prepared as the cross-linking agent CL-2.

(Preparation of Cross-Linking Agent CL-3)

A separable flask having a capacity of 0.3 L and equipped with a reflux condenser, a nitrogen inlet tube, a stirrer, and a thermometer was set in a water bath at a temperature of 30° C. Subsequently, 10 g of glycidyl methacrylate, 20 g of methyl methacrylate, 1.165 g of chain transfer agent (BT-BTPB: (1,4-bis(2-(thiobenzoylthio)prop-2-yl)benzene), 0.82 g of an initiator (2,2'-azobis(isobutyronitrile)), 40 mL of a solvent (methyl ethyl ketone), and 20 mL of toluene were added into the flask. Subsequently, the flask contents were subjected to bubbling with nitrogen gas for 15 minutes, and the internal temperature of the flask was raised up to 72° C. using the water bath. Subsequently, the flask contents were caused to react for 6 hours, and then the flask contents (reaction product) was put in methanol to precipitate the glycidyl group-containing polymer. Then, the precipitate (glycidyl group-containing polymer) was collected to obtain the cross-linking agent CL-3. The thus obtained cross-linking agent CL-3 (glycidyl group-containing polymer) was an acrylic acid-based resin having a glycidyl group content of 9.2 mmol/g and a mass average molecular weight (Mw) of 17,000.

(Preparation of Cross-Linking Agent CL-4)

The cross-linking agent CL-4 was prepared according to the same method as the preparation method of the cross-linking agent CL-3 in all aspects other than that the amount of the chain transfer agent (BTBTPB) was changed from 1.165 g to 0.565 g. The thus obtained cross-linking agent CL-4 (glycidyl group-containing polymer) was an acrylic acid-based resin having a glycidyl group content of 1.3 mmol/g and a mass average molecular weight (Mw) of 140,000.

(Preparation of Cross-Linking Agent CL-5)

A four-necked flask having a capacity of 10 L and equipped with a thermometer, a glass nitrogen inlet tube, a stirrer (stainless steel stirring impeller), and a falling-type condenser (heat exchanger) was charged with 200 g of an adduct of bisphenol A with 2 moles of ethylene oxide (EO), 50 g of trimellitic anhydride, and 54 g of tin(II) 2-ethylhexanoate. Subsequently, a nitrogen atmosphere (inert atmosphere) was maintained in the flask with nitrogen gas introduced into the flask through the nitrogen inlet tube. Subsequently, the flask contents were heated up to 235° C. under stirring in the nitrogen atmosphere. The flask contents were then caused to react (polycondensation reaction) at a temperature of 235° C. in the nitrogen atmosphere while the flask contents were stirred until all the resin raw materials (adduct of bisphenol A with 2 moles of EO and trimellitic anhydride) melted. Subsequently, the internal pressure of the flask was reduced, and the flask contents were caused to react at a temperature of 235° C. in the reduced pressure atmosphere (pressure 8.0 kPa) to yield a polyester resin. Thereafter, the flask contents were cooled.

Subsequently, 400 g of ethyl acetate was added into the flask, and the polyester resin in the flask was caused to dissolve therein. Subsequently, the internal temperature of the flask was raised up to 100° C. while the flask contents were stirred. Thereafter, 40 g of isophorone diisocyanate was added into the flask to cause the flask contents to react at a temperature of 100° C. for 5 hours. As a result, the cross-linking agent CL-5 (isocyanate group-containing polymer) was obtained. The thus obtained cross-linking agent CL-5 was a urethane modified polyester resin having an isocyanate group content of 1.3 mmol/g and a mass average molecular weight (Mw) of 2,300.

(Preparation of Cross-Linking Agent CL-6)

The cross-linking agent CL-6 was prepared according to the same method as the preparation method of the cross-linking agent CL-5 in all aspects other than that the amount of the trimellitic anhydride was changed from 50 g to 57 g, and the amount of the isophorone diisocyanate was changed from 40 g to 30 g. The thus obtained cross-linking agent CL-6 (isocyanate group-containing polymer) was a urethane modified polyester resin having an isocyanate group content of 0.5 mmol/g and a mass average molecular weight (Mw) of 6,000.

(Preparation of Cross-Linking Agent CL-7)

A low-molecular cross-linking agent (trimellitic anhydride) was prepared as the cross-linking agent CL-7.

(Preparation of Cross-Linking Agent CL-8)

A low-molecular cross-linking agent (pyromellitic anhydride) was prepared as the cross-linking agent CL-8.

(Preparation of Cross-Linking Agent CL-9)

A low-molecular cross-linking agent (2,2'-bis(2-oxazoline)) was prepared as the cross-linking agent CL-9.

The mass average molecular weight (Mw) and the cross-linking functional group content of each of the cross-linking agents CL-1 to CL-9 obtained as described above were measured, and results thereof were as shown in Table 2.

[Toner Production Method]

(Preparation of Toner Mother Particles)

With respect to each of the toners, a binder resin of a type (one of the non-crystalline polyester resins PES-A to PES-C that is specified for the toner) in an amount as shown under "Binder resin (PES)" in Table 1, a cross-linking agent of a type (one of the cross-linking agents CL-1 to CL-9 that is specified for the toner) in an amount as shown under "Cross-linking agent" in Table 1, 9 parts by mass of a releasing agent (ester wax: "NISSAN ELECTOL (registered Japanese trademark) WEP-8", product of NOF Corporation), and 9 parts by mass of a colorant (carbon black: "MA-100", product of Mitsubishi Chemical Corporation) were mixed using an FM mixer ("FM-20B", product of Nippon Coke & Engineering Co., Ltd.).

For example, in the production of the toner TA-1, 60 parts by mass of the non-crystalline polyester resin PES-B, 20 parts by mass of the non-crystalline polyester resin PES-C, 1 part by mass of the cross-linking agent CL-1, 9 parts by mass of the releasing agent (NISSAN ELECTOL WEP-8), and 9 parts by mass of the colorant (MA-100) were mixed. For another example, in the production of the toner TA-7, 40 parts by mass of the non-crystalline polyester resin PES-A, 40 parts by mass of the non-crystalline polyester resin PES-C, 1 part by mass of the cross-linking agent CL-4, 9 parts by mass of the releasing agent (NISSAN ELECTOL WEP-8), and 9 parts by mass of the colorant (MA-100) were mixed.

Subsequently, the resultant mixture was melt-kneaded under conditions of a material feeding speed of 100 g/minute, a shaft rotational speed of 150 rpm, and a cylinder temperature of 100° C. using a twin-screw extruder ("PCM-30", product of Ikegai Corp.). Thereafter, the resultant kneaded product was cooled. Subsequently, the cooled kneaded product was coarsely pulverized using a pulverizer ("ROTOPLEX (registered Japanese trademark)", product of Hosokawa Micron Corporation) under a condition of a set particle diameter of 2 mm. Subsequently, the resultant coarsely pulverized product was finely pulverized using a pulverizer ("Turbo Mill Type RS", product of FREUND-TURBO CORPORATION). Subsequently, the resultant finely pulverized product was classified using a classifier (classifier using the Coanda effect: "Elbow Jet Type EJ-LABO", product of Nittetsu Mining Co., Ltd.). As a result, toner mother particles having a volume median diameter ($D_{50}$) of 6.7 μm were obtained.

(External Additive Addition Process)

Subsequently, an external additive was added to the resultant toner mother particles. Specifically, 100 parts by mass of the toner mother particles and 1 part by mass of positively chargeable silica particles ("AEROSIL (registered Japanese trademark) REA90", product of Nippon Aerosil Co., Ltd., content: dry silica particles to which positive chargeability was imparted through surface treatment, number average primary particle diameter: 20 nm) were mixed for 5 minutes using an FM mixer (product of Nippon Coke & Engineering Co., Ltd.) having a capacity of 10 L to cause the external additive (silica particles) to adhere to the surfaces of the toner mother particles. Subsequently, the resultant powder was sifted using a 200-mesh sieve (pore size 75 μm). Thus, each of the toners (toners TA-1 to TA-7 and TB-1 to TB-9 shown in Table 1) including a large number of toner particles was obtained.

With respect to each of the toners TA-1 to TA-7 and TB-1 to TB-9 obtained as described above, the amount of THF insolubles in the toner (specifically, mass percentage thereof in the toner), the storage elastic modulus $G'_{80}$ (storage elastic modulus of the toner at a temperature of 80° C.), the storage elastic modulus $G'_{120}$ (storage elastic modulus of the toner at a temperature of 120° C.), the temperature $T_{10000}$ (specifically, temperature at which the storage elastic modulus of the toner reaches $1.0\times10^4$ Pa), the loss tangent tan δx (specifically, loss tangent of the toner at a temperature of $T_{10000}$+70° C.), and the cross-linking density Nx were measured, and results thereof were as shown in Table 3.

TABLE 3

| Toner | THF insolubles [% by mass] | Storage elastic modulus [Pa] $G'_{80}$ | Storage elastic modulus [Pa] $G'_{120}$ | $T_{1000}$ (G' = 10000) [° C.] | Viscoelasticity at $T_{10000}$ + 70° C. Loss tangent tanδx | Viscoelasticity at $T_{10000}$ + 70° C. Cross-linking density Nx [mol/cm³] |
|---|---|---|---|---|---|---|
| TA-1 | 0.19 | $1.8\times10^3$ | $1.2\times10^3$ | 72 | 0.12 | $6.9\times10^{-7}$ |
| TA-2 | 0.21 | $9.2\times10^3$ | $3.1\times10^3$ | 78 | 0.33 | $1.6\times10^{-6}$ |
| TA-3 | 0.24 | $2.3\times10^4$ | $5.3\times10^3$ | 88 | 0.29 | $8.7\times10^{-7}$ |
| TA-4 | 0.27 | $3.8\times10^4$ | $7.5\times10^3$ | 96 | 0.45 | $2.9\times10^{-7}$ |
| TA-5 | 0.31 | $4.2\times10^4$ | $8.8\times10^3$ | 110 | 0.08 | $2.1\times10^{-6}$ |
| TA-6 | 0.47 | $4.9\times10^4$ | $9.9\times10^3$ | 118 | 0.47 | $1.1\times10^{-6}$ |
| TA-7 | 0.02 | $1.6\times10^4$ | $1.8\times10^3$ | 84 | 0.36 | $3.0\times10^{-7}$ |
| TB-1 | 1.89 | $9.1\times10^4$ | $9.4\times10^3$ | 116 | 0.04 | $5.8\times10^{-6}$ |
| TB-2 | 0.44 | $4.3\times10^4$ | $1.7\times10^3$ | 88 | 0.72 | $2.8\times10^{-7}$ |
| TB-3 | 2.44 | $7.2\times10^4$ | $8.8\times10^3$ | 112 | 0.03 | $7.3\times10^{-6}$ |
| TB-4 | 0.82 | $6.7\times10^4$ | $9.0\times10^3$ | 110 | 0.34 | $3.6\times10^{-6}$ |
| TB-5 | 0.36 | $5.9\times10^4$ | $8.7\times10^3$ | 110 | 0.19 | $3.0\times10^{-6}$ |
| TB-6 | 0.28 | $6.8\times10^4$ | $9.2\times10^3$ | 108 | 0.40 | $2.1\times10^{-7}$ |
| TB-7 | 0.12 | $8.9\times10^3$ | $3.3\times10^3$ | 76 | 0.91 | $1.8\times10^{-7}$ |
| TB-8 | 0.59 | $6.4\times10^4$ | $1.1\times10^4$ | 122 | 0.10 | $3.0\times10^{-6}$ |
| TB-9 | 0.01 | $1.5\times10^4$ | $4.0\times10^3$ | 84 | 0.99 | $8.4\times10^{-7}$ |

For example, the toner TA-1 had a THF insoluble amount of 0.19% by mass, a storage elastic modulus $G'_{80}$ of $1.8\times10^3$ Pa, a storage elastic modulus $G'_{120}$ of $1.2\times10^3$ Pa, a temperature $T_{10000}$ of 72° C., a loss tangent tan δx (loss tangent of the toner at a temperature of 142° C.) of 0.12, and a cross-linking density Nx of $6.9\times10^{-7}$ mol/cm³. These properties were measured according to methods described below.

<Measurement Method of THF Insoluble Amount in Toner>

Into a sample jar, 100 mL of tetrahydrofuran (THF) and 1 g of a sample (toner) were added and left to stand for 12 hours under environmental conditions of a temperature of 25° C. and a relative humidity of 50%. The liquid in the sample jar was subjected to vacuum filtration (solid-liquid separation) using a Buchner funnel. Subsequently, the solvent (THF, ethyl acetate, and chloroform) in the resultant filtrate was evaporated to collect a solid (THF soluble substance). Subsequently, the mass of the solid (THF soluble substance) was measured. The THF insoluble amount (unit: % by mass) of the toner was determined in accordance with the following formula: "Amount of THF insolubles in toner=100×(1 g−mass of THF soluble substance)/1 g".

<Measurement Methods of Storage Elastic Moduli $G'_{80}$, $G'_{120}$, Loss Tangent Tan δx, and Cross-Linking Density Nx>

A sample (toner) in an amount of 0.1 g was set in a pelleting machine, and a pressure of 4 MPa was applied to the toner to obtain a cylindrical pellet having a diameter of 10 mm and a thickness of 1.5 mm. Subsequently, the thus obtained pellet was set in a measuring device. A rheometer ("Physica MCR-301", product of Anton Paar GmbH) was used as the measuring device. A measurement jig (parallel plate) was attached to an end of a shaft (specifically, a shaft that is driven by a motor) of the measuring device. The pellet was placed on a plate (a heating stage that is heated by a heater) of the measuring device. The pellet on the plate was heated up to 110° C. to melt the pellet (a mass of the toner). Once the toner completely melted, the measurement jig (parallel plate) was lowered into close contact with the melted toner to hold the toner between the two plates parallel to each other (upper plate: measurement jig, lower plate: heating stage). The toner was then cooled to 40° C. Thereafter, dynamic viscoelasticity of the sample (toner) was measured using the measuring device under conditions of a measurement temperature range of 40° C. to 200° C., a heating rate of 2° C./minute, and a vibration frequency of 1 Hz. Specifically, the storage elastic modulus $G'_{80}$ (storage elastic modulus of the toner at a temperature of 80° C.), the storage elastic modulus $G'_{120}$ (storage elastic modulus of the toner at a temperature of 120° C.), the temperature $T_{10000}$ (temperature at which the storage elastic modulus of the toner reached $1.0\times10^4$ Pa), the loss tangent tan δx (loss tangent of the toner at a temperature of $T_{10000}$+70° C.), and the cross-linking density Nx were measured as the dynamic viscoelasticity of the sample (toner).

The cross-linking density Nx was calculated in accordance with formula (1) shown below. The gas constant was $8.31\times10^7$ dyne·cm/mol·K.

$$Nx=10\times Gx/R\times(T_{10000}+343) \quad (1)$$

In formula (1), Gx represents a storage elastic modulus [Pa] of the toner at a temperature of $T_{10000}$+70° C., R represents a gas constant, and $T_{10000}$ represents a temperature [° C.] at which the storage elastic modulus of the toner reaches $1.0\times10^4$ Pa.

The loss tangent tan δx was calculated in accordance with formula (2) shown below.

$$\tan\delta x=Gy/Gx \quad (2)$$

In formula (2), Gx represents a storage elastic modulus [Pa] of the toner at a temperature of $T_{10000}$+70° C., Gy represents a loss elastic modulus [Pa] of the toner at a temperature of $T_{10000}$+70° C., and $T_{10000}$ represents a temperature [° C.] at which the storage elastic modulus of the toner reaches $1.0\times10^4$ Pa.

[Evaluation Methods]

Each of the samples (toners TA-1 to TA-7 and TB-1 to TB-9) was evaluated according to methods described below.

(Heat-Resistant Preservability)

A polyethylene container having a capacity of 20 mL was charged with 2 g of a sample (toner) and left to stand in a thermostatic chamber set at 58° C. for 3 hours. The toner was then taken out of the thermostatic chamber and cooled at 20° C. for 3 hours to give an evaluation toner.

Subsequently, the resultant evaluation toner was placed on a 100-mesh sieve (pore size 150 μm) of known mass. The mass of the toner on the sieve (mass of toner before sifting) was calculated by measuring the total mass of the sieve and the evaluation toner thereon. Subsequently, the sieve was set in a powder property evaluation machine ("POWDER TESTER (registered Japanese trademark)", product of Hosokawa Micron Corporation) and the evaluation toner was sifted by shaking the sieve for 30 seconds at a rheostat level of 5 in accordance with a manual of the powder tester. After the sifting, the mass of toner remaining on the sieve (toner that did not pass through the sieve) was calculated (mass of toner after sifting) by measuring the total mass of the sieve and the toner thereon. Aggregation rate (unit: % by mass) was calculated from the mass of the toner before sifting and the mass of the toner after sifting in accordance with a formula shown below.

$$\text{Aggregation rate}=100\times(\text{mass of toner after sifting})/(\text{mass of toner before sifting})$$

Heat-resistant preservability was evaluated as "good" if the aggregation rate was lower than 10% by mass and evaluated as "poor" if the aggregation rate was higher than or equal to 10% by mass.

(Low-Temperature Fixability, Hot Offset Resistance)

A two-component developer was prepared by mixing 100 parts by mass of a developer carrier (carrier for FS-C5250DN) with 5 parts by mass of the sample (toner) for 30 minutes using a ball mill.

The two-component developer prepared as described above was used to form an image to determine minimum fixable temperature and maximum fixable temperature. A printer (evaluation apparatus obtained by modifying "FS-C5250DN", product of KYOCERA Document Solutions Inc., to enable adjustment of fixing temperature) having a roller-roller type heat-pressure fixing device was used as an evaluation apparatus. The two-component developer prepared as described above was loaded into a developing device of the evaluation apparatus, and the sample (toner for replenishment use) was loaded into a toner container of the evaluation apparatus.

The evaluation apparatus was used to form a solid image (specifically, unfixed toner image) having a size of 25 mm×25 mm on paper ("$C^2$90", A4 size 90 g/$m^2$ plain paper, product of Fuji Xerox Co., Ltd.,) in a portion thereof that was 10 mm away from a trailing end of the paper at a linear velocity of 200 mm/second and a toner application amount of 1.0 mg/$cm^2$ under environmental conditions of a temperature of 23° C. and a relative humidity of 55%. Subsequently, the paper with the image formed thereon was passed through the fixing device of the evaluation apparatus.

The fixing temperature was measured within a range of from 100° C. to 150° C. to evaluate minimum fixable temperature. The fixing temperature of the fixing device was increased in increments of 2° C. from 100° C. to determine the minimum temperature at which the solid image (toner image) was fixable to the paper (minimum fixable temperature). Determination of whether or not the toner was fixable was carried out through a fold-rubbing test described below. Specifically, the evaluation paper passed through the fixing device was folded with a surface on which the image was formed facing inward and a 1 kg weight covered with cloth was rubbed back and forth on the fold with the image five times. Subsequently, the paper was opened up and a fold portion (portion on which the solid image was formed) of the paper was observed. Then, the length of toner peeling of the fold portion (peeling length) was measured. The minimum fixable temperature was determined to be the lowest temperature among fixing temperatures for which the peeling length was no greater than 1 mm. Low-temperature fixability was evaluated as "good" if the minimum fixable temperature was less than 110° C. and evaluated as "poor" if the minimum fixable temperature was greater than or equal to 110° C.

The fixing temperature was measured within a range of from 150° C. to 200° C. to evaluate maximum fixable temperature. The fixing temperature of the fixing device was increased in increments of 2° C. from 150° C. to determine a maximum temperature at which offset did not occur (maximum fixable temperature). Whether or not offset occurred (the toner adhered to a fixing roller) on the paper passed through the fixing device was determined by visual observation. Hot offset resistance was evaluated as "good" if the maximum fixable temperature was greater than or equal to 170° C. and evaluated as "poor" if the maximum fixable temperature was lower than 170° C.

[Evaluation Results]

Table 4 shows evaluation results of the toners TA-1 to TA-7 and TB-1 to TB-9. Table 4 shows values measured with respect to low-temperature fixability (minimum fixable temperature), hot offset resistance (maximum fixable temperature), and heat-resistant preservability (aggregation rate).

TABLE 4

| | Toner | Low-temperature fixability [° C.] | Hot offset resistance [° C.] | Heat-resistant preservability [% by mass] |
|---|---|---|---|---|
| Example 1 | TA-1 | 100 | 172 | 8 |
| Example 2 | TA-2 | 102 | 174 | 6 |
| Example 3 | TA-3 | 104 | 176 | 4 |
| Example 4 | TA-4 | 106 | 178 | 4 |
| Example 5 | TA-5 | 108 | 182 | 2 |
| Example 6 | TA-6 | 108 | 198 | 2 |
| Example 7 | TA-7 | 108 | 172 | 6 |
| Comparative Example 1 | TB-1 | 120 (poor) | 178 | 2 |
| Comparative Example 2 | TB-2 | 108 | 164 (poor) | 18 (poor) |
| Comparative Example 3 | TB-3 | 118 (poor) | 176 | 4 |
| Comparative Example 4 | TB-4 | 116 (poor) | 174 | 6 |
| Comparative Example 5 | TB-5 | 112 (poor) | 172 | 10 (poor) |
| Comparative Example 6 | TB-6 | 116 (poor) | 168 (poor) | 16 (poor) |
| Comparative Example 7 | TB-7 | 104 | 160 (poor) | 32 (poor) |
| Comparative Example 8 | TB-8 | 116 (poor) | 184 | 6 |
| Comparative Example 9 | TB-9 | 106 | 158 (poor) | 28 (poor) |

The toners TA-1 to TA-7 (toners according to Examples 1 to 7) each had the above-described basic features. The toner particles of each of the toners TA-1 to TA-7 had a cross-linking structure originating from a high-molecular cross-linking agent (one of the cross-linking agents CL-1 to CL-4). The storage elastic modulus $G'_{80}$ thereof (storage elastic modulus of the toner at a temperature of 80° C.) was at least $1.0\times10^3$ Pa and no greater than $5.0\times10^4$ Pa (see Table 3). The storage elastic modulus $G'_{120}$ thereof (storage elastic modulus of the toner at a temperature of 120° C.) was at least $1.0\times10^3$ Pa and no greater than $1.0\times10^4$ Pa (see Table 3). The cross-linking density Nx thereof was at least $2.9\times10^{-7}$ mol/cm$^3$ and no greater than $2.5\times10^{-6}$ mol/cm$^3$ (see Table 3). The loss tangent tan δx thereof was at least 0.05 and no greater than 0.50 (see Table 3).

The storage elastic modulus $G'_{150}$ of each of the toners TA-1 to TA-7 (storage elastic modulus of the toner at a temperature of 150° C.) was measured according to the same method as the measurement of the storage elastic moduli $G'_{80}$ and $G'_{120}$ to be at least $1.0\times10^2$ Pa and no greater than $1.0\times10^4$ Pa.

As shown in Table 4, each of the toners TA-1 to TA-7 (toners according to Examples 1 to 7) had viscoelasticity suitable for both low-temperature fixing and high-temperature fixing, and was excellent in all of low-temperature fixability, hot offset resistance, and heat-resistant preservability.

INDUSTRIAL APPLICABILITY

The electrostatic latent image developing toner according to the present invention is usable for image formation in copiers, printers, or multifunction peripherals, for example.

The invention claimed is:

1. An electrostatic latent image developing toner comprising a plurality of toner particles containing a binder resin, wherein the toner particles have a cross-linking structure originating from a high-molecular cross-linking agent, a storage elastic modulus of the toner at a temperature of 80° C. is at least $1.0\times10^3$ Pa and no greater than $5.0\times10^4$ Pa, a storage elastic modulus of the toner at a temperature of 120° C. is at least $1.0\times10^3$ Pa and no greater than $1.0\times10^4$ Pa, a cross-linking density Nx represented by formula (1) is at least $2.9\times10^{-7}$ mol/cm$^3$ and no greater than $2.5\times10^{-6}$ mol/cm$^3$, and a loss tangent tank represented by formula (2) is at least 0.05 and no greater than 0.50, $$Nx=10\times Gx/R\times(T_{10000}+343) \quad (1)$$

where in formula (1), Gx represents a storage elastic modulus [Pa] of the toner at a temperature of $T_{10000}$+70° C., R represents a gas constant, and $T_{10000}$ represents a temperature [° C.] at which the storage elastic modulus of the toner reaches $1.0\times10^4$ Pa, and $$\tan\delta x=Gy/Gx \quad (2)$$

in formula (2), Gx represents a storage elastic modulus [Pa] of the toner at a temperature of $T_{10000}$+70° C., Gy represents a loss elastic modulus [Pa] of the toner at a temperature of $T_{10000}$+70° C., and $T_{10000}$ represents a temperature [° C.] at which the storage elastic modulus of the toner reaches $1.0\times10^4$ Pa.

2. The electrostatic latent image developing toner according to claim 1, wherein the high-molecular cross-linking agent is a copolymer of at least one vinyl compound having a cross-linking functional group and at least one vinyl compound having no cross-linking functional group.

3. The electrostatic latent image developing toner according to claim 2, wherein the toner particles contain a polyester resin and a polymer including a repeating unit represented by formula (1-1) shown below, and the polyester resin and the polymer are bonded to each other in a manner represented by formula (1-2) shown below through opening of oxazoline groups of at least some molecules of the repeating unit represented by formula (1-1) in the polymer,

[Formula 1]

(1-1)

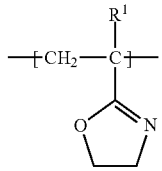

where in formula (1-1), $R^1$ represents a hydrogen atom or an optionally substituted alkyl group, and

[Formula 2]

(1-2)

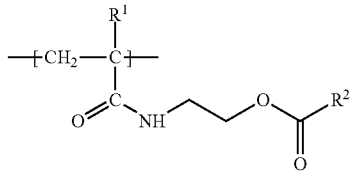

in formula (1-2), $R^1$ represents the same group as $R^1$ in formula (1-1), and "$R^2$—COO—" represents an end of an acid component of the polyester resin.

4. The electrostatic latent image developing toner according to claim 2, wherein the toner particles contain a polyester resin and a polymer including a repeating unit represented by formula (2-1) shown below, and the polyester resin and the polymer are bonded to each other in a manner represented by formula (2-2) shown below through opening of glycidyl groups of at least some molecules of the repeating unit represented by formula (2-1) in the polymer,

[Formula 3]

(2-1)

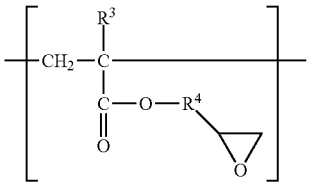

where in formula (2-1), $R^3$ represents a hydrogen atom or an optionally substituted alkyl group, and $R^4$ represents an optionally substituted alkylene group, and

[Formula 4]

(2-2)

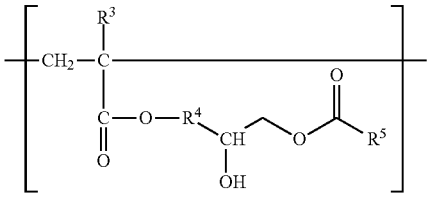

in formula (2-2), $R^3$ and $R^4$ respectively represent the same groups as $R^3$ and $R^4$ in formula (2-1), and "$R^5$—COO—" represents an end of an acid component of the polyester resin.

5. The electrostatic latent image developing toner according to claim 1, wherein the toner particles contain a non-crystalline polyester resin as the binder resin, and the high-molecular cross-linking agent has either or both of an oxazoline group and a glycidyl group as a cross-linking functional group.

6. The electrostatic latent image developing toner according to claim 5, wherein the toner particles contain no crystalline polyester resin.

7. The electrostatic latent image developing toner according to claim 5, wherein the high-molecular cross-linking agent has a cross-linking functional group content of at least 1.0 mmol/g and no greater than 10.0 mmol/g, the high-molecular cross-linking agent has a mass average molecular weight of at least 10,000 and no greater than 150,000, and tetrahydrofuran insolubles account for at least 0.01% by mass and no greater than 0.50% by mass of the toner.

8. The electrostatic latent image developing toner according to claim 6, wherein the toner particles contain different non-crystalline polyester resins as the binder resin, and the toner particles are a kneaded and pulverized product including at least the different non-crystalline polyester resins and the high-molecular cross-linking agent.

9. The electrostatic latent image developing toner according to claim 8, wherein the different non-crystalline polyester resins include a non-crystalline polyester resin having a softening point of less than 100° C. and a non-crystalline polyester resin having a softening point of at least 120° C., each of the different non-crystalline polyester resins contains at least one bisphenol as an alcohol component, and a storage elastic modulus of the toner at a temperature of 150° C. is at least $1.0\times10^2$ Pa.

* * * * *